US005812046A

United States Patent [19]

Brown et al.

[11] Patent Number: 5,812,046

[45] Date of Patent: Sep. 22, 1998

[54] SUBMINIATURE FUSE AND METHOD FOR MAKING A SUBMINIATURE FUSE

[75] Inventors: Russell Brown, Leicestershire, United Kingdom; Farid Ghaderi; Varinder K. Kalra, both of Chesterfield, Mo.; Keith A. Spalding, Fenton, Mo.; Joan L. Winnett, Chesterfield, Mo.; Stephen J. Whitney, Manchester, Mo.

[73] Assignee: Cooper Technologies, Inc., Houston, Tex.

[21] Appl. No.: 792,177

[22] Filed: Jan. 30, 1997

[51] Int. Cl.[6] ..... H01H 85/044; H01H 85/157; H01H 69/02

[52] U.S. Cl. ..... 337/290; 337/297; 337/159; 337/227; 29/623

[58] Field of Search ..... 337/231, 232, 337/237, 248, 251, 252, 253, 254, 227, 228, 166, 186, 414, 245, 246, 255, 273, 158, 279, 260, 297, 290, 233; 29/623, 619, 844, 855

[56] References Cited

U.S. PATENT DOCUMENTS

| | | | |
|---|---|---|---|
| 4,035,753 | 7/1977 | Reeder | 337/186 |
| 4,237,440 | 12/1980 | Miyasaka et al. | 337/227 |
| 4,540,969 | 9/1985 | Sugar . | |
| 4,680,567 | 7/1987 | Edwards . | |
| 4,703,300 | 10/1987 | Gaia . | |
| 4,873,506 | 10/1989 | Gurevich | 337/290 |
| 5,077,534 | 12/1991 | Douglass . | |
| 5,150,093 | 9/1992 | Badihi et al. . | |
| 5,166,656 | 11/1992 | Badihi et al. . | |
| 5,198,792 | 3/1993 | Bacon et al. | 337/251 |
| 5,214,406 | 5/1993 | Reese et al. . | |
| 5,228,188 | 7/1993 | Badihi et al. . | |
| 5,296,833 | 3/1994 | Breen et al. . | |
| 5,432,378 | 7/1995 | Whitney et al. . | |
| 5,552,757 | 9/1996 | Blecha et al. . | |
| 5,617,069 | 4/1997 | Arikawa et al. . | |
| 5,664,320 | 9/1997 | Gurevich | 29/623 |

OTHER PUBLICATIONS

"Flowchart For Loading Tooling and Sealing Thyristors in SST DAP–2200 Furnance." *Scientific Sealing Technology.,* Downy, California (no date provided).

*Primary Examiner*—Leo P. Picard
*Assistant Examiner*—Anatoly Vortman
*Attorney, Agent, or Firm*—Burns, Doane, Swecker & Mathis, L.L.P.

[57] ABSTRACT

A method for manufacturing a subminiature fuse includes the steps of applying metallized coatings to surfaces at axially opposite ends of a hollow fuse body, placing a fuse element in an internal cavity in the fuse body, the fuse element extending from the first end to the second end of the cavity, placing a one of a solder and brazing preform and end termination at each of the first and second ends of the cavity, and heating the assembled fuse body, fuse element, solder preforms and end terminations to a temperature sufficient to cause the solder preforms to bond the fuse element to the end terminations and for the end terminations to bond with the metallized end portions of the fuse body, wherein the end terminations form hermetic seals closing the ends of the cavity. A subminiature fuse according to the invention includes a fuse body with a fuse element diagonally disposed in the body. The fuse body includes metallized end portions to which the end terminations are bonded. One of a solder and brazing preform bond the fuse element to the end terminations.

26 Claims, 3 Drawing Sheets

SUBMINIATURE FUSE AND METHOD FOR MAKING A SUBMINIATURE FUSE

BACKGROUND AND SUMMARY

The present invention is directed to a subminiature fuse and a method for making a subminiature fuse. More particularly, the invention relates to a subminiature fuse having a tubular body and a fuse element disposed within the interior of the body.

Manufacturing subminiature fuses is labor and time intensive in handling and assembling the parts and in connecting the fuse element to the end terminations. This is of particular concern in manufacturing subminiature time lag fuses, in which a fuse element is disposed between the end terminations in air or gas.

The present invention provides a method for manufacturing subminiature fuses that is a low-cost, batch process method. The method is suitable for manufacturing a variety of subminiature fuses, including time-lag fuses, surface mount fuses, leaded fuses, and other types, as will be understood through the following description.

The present invention also provides a subminiature fuse that is capable of withstanding the stresses of circuit board assembly, soldering, and cleaning without degradation of the fuse or its operability. The present invention provides a subminiature fuse with a hermetically sealed cavity to contain the fusible element.

According to the invention, an elongated, hollow fuse body, having an internal cavity for containing a fuse element, is coated at end portions with a metallic material. Upon assembly of a fuse element and end terminations with the fuse body, the unit is heated and the metallic coating, the end terminations and fuse element are bonded together forming a seal to close the cavity of the fuse body.

According to the invention, the end terminations may comprise end plates formed of electrical conductive material, which are attached to end faces of the fuse body. The end plates are soldered or brazed to the end faces of the body on the metallized coating, which facilitates forming a secure bond. A preferred form for the end plates is disk shaped, which eliminates the need to orient the end plate to the side edges of the fuse body. The end terminations may alternatively comprise caps which are placed over the metallized end portions of the fuse body. The solder or brazing alloy preforms on the end portions of the fuse body will melt and bond with the end caps or the disk-shaped elements to form the seal of the interior cavity. The end plates or caps may be provided with axially-extending leads, if desired.

A method according to the invention includes the steps of applying metallized coatings to axially opposite surface end portions of a hollow fuse body and placing a fuse element in the internal cavity in the fuse body so that the fuse element extends from the first end to the second end of the cavity. A solder or brazing alloy preform is placed at each of the first and second ends of the cavity and an end termination is placed at each of the first and second ends in contact with the preform. The assembly thus formed is heated to a temperature sufficient to cause the solder preforms to soften and flow for bonding the fuse element to the end terminations. The metallized portions also soften to bond the end terminations to the fuse body. The end terminations then form hermetic seals closing the ends of the cavity.

According to another aspect of the invention, the method includes the steps, prior to the heating step, of placing the assembled fuse body, fuse element, solder or brazing preforms and end terminations in an environmentally controlled chamber, and charging the chamber with a selected gas so that the cavity is filled with the selected gas before being sealed.

According to the invention, the selected gas may be at a pressure greater than atmospheric pressure, or alternately at a pressure less than atmospheric pressure.

The selected gas may be an inert gas, such as nitrogen. Alternatively, the gas may be sulfur hexafluoride, which is believed to provide arc suppression, to improve the interrupting ability of the fuse.

According to another aspect of the invention, the fuse body is placed in a vertically-oriented recess in a fixture. The fuse element is then placed in the cavity in the fuse body and naturally assumes a diagonal orientation over the length of the cavity. The fuse components are heated for bonding in this fixture, which eliminates special handling of the fuse element to achieve a gas or air insulation around the fuse element. According to another aspect of the invention, the fixture may be vibrated in stages to cause the fuse bodies and fuse element to enter the recesses in the fixture.

The fuse element includes a substantially rigid structure so that it maintains the diagonal orientation in the cavity and avoids contact with the inside surface of the fuse body. The fuse element may comprise a wire element wound on an electrically insulating core. Alternatively, the fuse element may comprise an electrically conductive film element carried on an electrically insulating substrate. Other rigid fuse element structures may also be suitable, for example, a metallic link or a wire.

BRIEF DESCRIPTION OF THE DRAWINGS

The invention will be better understood through the following description in conjunction with the appended drawings, which are not drawn to scale and are simplified for the purposes of the description. In the drawings.

DETAILED DESCRIPTION

Figure 1:
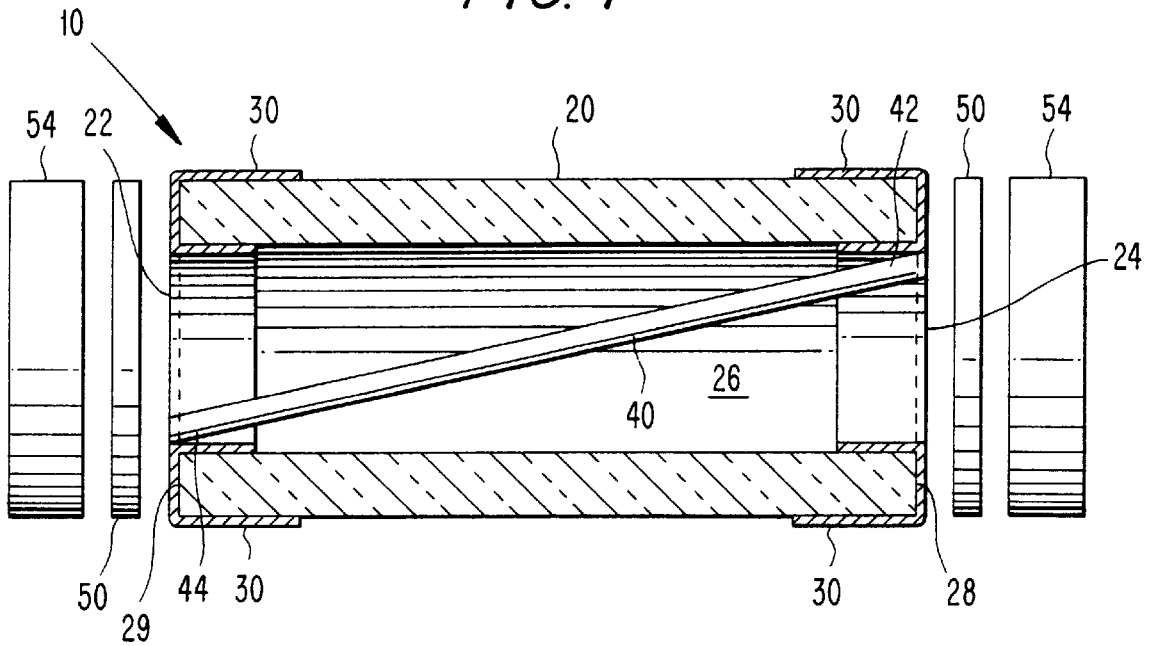
FIG. 1 is an exploded view of a subminiature fuse in accordance with the invention.

As shown in FIG. 1 in an exploded view, a subminiature fuse 10 in accordance with the invention includes an elongated, hollow body 20 having opposite open first and second ends 22, 24. The body 20 is a tubular element, preferably shaped with a rectangular profile, as seen in the end view of FIG. 2, and has a central cavity 26 extending from a first end 22 to a second end 24. A rectangular profile facilitates handling of the fuse for mounting on a circuit board, for example.

The body 20 is formed of an electrically insulating material, preferably capable of withstanding high temperature, solder and brazing processing. Suitable materials include glass, a glass and mica blend, quartz, alumina, forsterite, Mykroy®, Mycalex®, or a type of MgO—$Al_2O_3$—$SiO_2$ ternary system.

Portions of the fuse body 20 at the opposite ends 22, 24 are provided with a coating 30 of metal or metallized material that is capable of conducting electricity. The coating 30 is applied to the end portions by any convenient method, including deposition or dipping in molten material, for example, a thick film paste. The coating 30 is applied to at least the end faces 28, 29 of the fuse body 20, and preferably is applied also to the outside lateral surface. More preferably, the inside surface is also coated with the metallization coating, as is shown in FIG. 1. As will be explained in greater detail below, the metallization coating 30 helps to seal the end openings 22, 24 of the fuse body 20 to end terminations, and also facilitates forming the electrical connection between the fuse element and the end terminations. The metallization coating also facilitates forming electrical connection and mechanical attachment to a circuit board.

A fuse element 40 is disposed in the cavity 26 of the fuse body 20 and extends from the first end 22 to the second end 24. As shown in FIG. 1, the fuse element 40 is disposed diagonally across the cavity 26 so that only the opposite ends 42, 44 of the fuse element are in contact with the fuse body 20. This arrangement is preferred for time-lag fuse construction to provide air or gas insulation surrounding the fuse element 40. Also, as shown, the fuse element 40 does not extend outside of the cavity 26 and is contained entirely within the fuse body 20, which facilitates manufacturing the fuse in accordance with the method of the present invention, as further described below.

Figure 6:
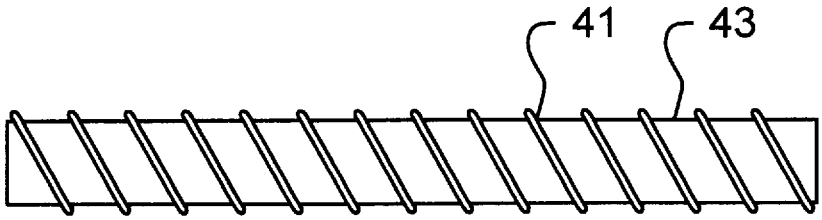
FIG. 6 illustrates a wire fuse element wound on a substrate.
Figure 7:
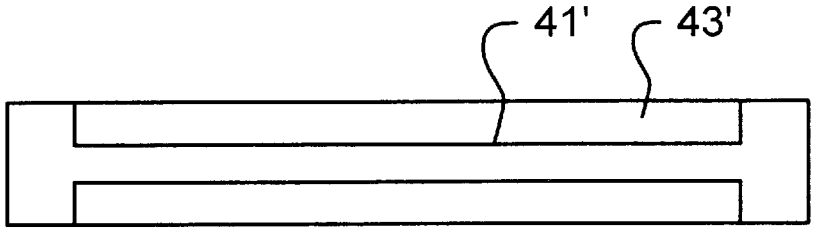
FIG. 7 illustrates a printed film fuse element carried on a substrate.

The fuse element 40 includes an electrically conductive fusible portion that is selected to fuse, that is, interrupt electric current, under selected conditions. The fuse element 40 is sufficiently rigid to maintain the diagonal disposition. As shown in FIG. 6, the fuse element 40 may be a spiral-wound wire 41 on a suitable electrically insulating core material 43, for example, silicon, fiberglass, and ceramic. The fuse element can also be a spiral-wound wire on an electrically conductive core of higher resistance. Alternatively, as shown in FIG. 7, the fuse element 40 may be a conductive film 41' deposited on an elongated substrate 43'. The core or substrate can be provided with conductive terminations at the ends 42, 44 to improve connecting the fuse element 40 to end terminations in the fuse 10. A straight wire or metal link element may alternatively be used for certain interrupting conditions.

Figure 2:
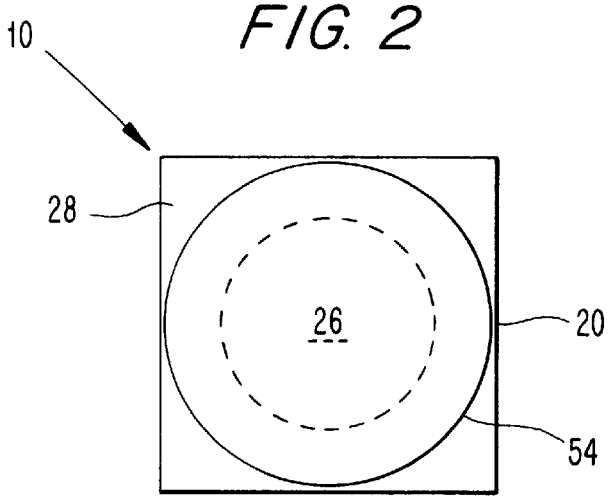
FIG. 2 is an end view of the subminiature fuse of FIG. 1.
Figure 3:
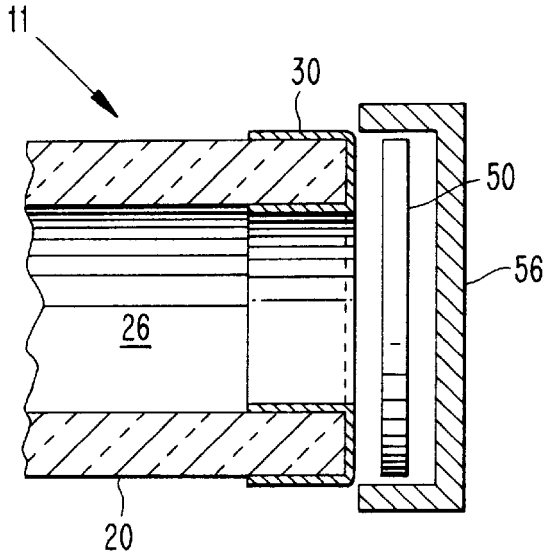
FIG. 3 is a partial view of an alternative embodiment of the subminiature fuse of FIG. 1.
Figure 4:
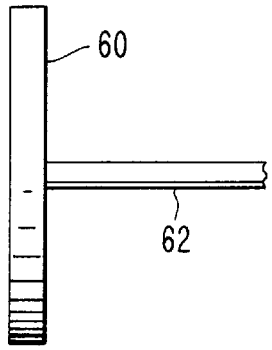
FIG. 4 is a side view of an end termination with a lead, which may be used alternatively in the fuse of FIG. 1.

At the first 22 and second 24 ends, solder or brazing preforms 50 are connected to the fuse body 20. End terminations are provided for connecting the fuse 10 in an electrical circuit. Shown in FIG. 1, the end terminations are end plates 54 attached to the solder or brazing preforms 50 and fuse body 20. As seen in FIG. 2, the end plates 54 are disk-shaped plates, which facilitates assembly because no orientation or alignment of the end plates 54 with the end faces of the fuse body 20 is necessary, as may be appreciated from the view of FIG. 2. FIG. 3 and FIG. 4 illustrate alternative end terminations that can be used for a fuse according to the invention. In FIG. 3, which is an exploded, partial view of an end of a fuse 11, the end termination is a cap 56, which is placed over an end portion of the fuse body 20 in contact with the solder preform 50 and the metallization coating 30 on the outer surface of the fuse body 20. FIG. 4 illustrates in side view an end plate 60 having a lead 62. The leaded end plate 60 is disposed on the fuse body 20 in the same manner as the end plate 54 of FIG. 1, that is, in abutting relationship with the solder or brazing preform and end surface of the fuse body. The cap 56 of FIG. 3 may alternatively be formed to include a lead similar to that shown in FIG. 4.

The solder or brazing preforms 50 are attached directly to the end faces of the fuse body 20 and to the ends of the fuse element 40 by heating to the softening point the preform material, which allows it to flow and bond the end terminations to the fuse element 40. The preform 50 also bonds with the end plates to the metallized ends of the fuse body 20.

In the embodiment of FIG. 3, the end termination cap 56 is further bonded to the fuse body 20 by the metallization coating 30 on the outer lateral surfaces of the fuse body 20.

The metallized coating 30 facilitates bonding of the preforms 50 and end terminations with the fuse body 20 and the formation of a seal to close the open ends 22, 24 of the fuse body. The cavity 26 may thus be sealed to provide a closed environment for a fuse element. The sealed cavity 26 may accordingly be provided with a selected environment, a selected gas at a selected pressure. A gas with arc-quenching properties may be selected to improve the current interrupting capability of the fuse, and may be for example, sulfur hexafluoride. The gas environment may be selected for insulation value for time-lag fuse construction. An inert gas, nitrogen or another, may be selected.

Figure 5:
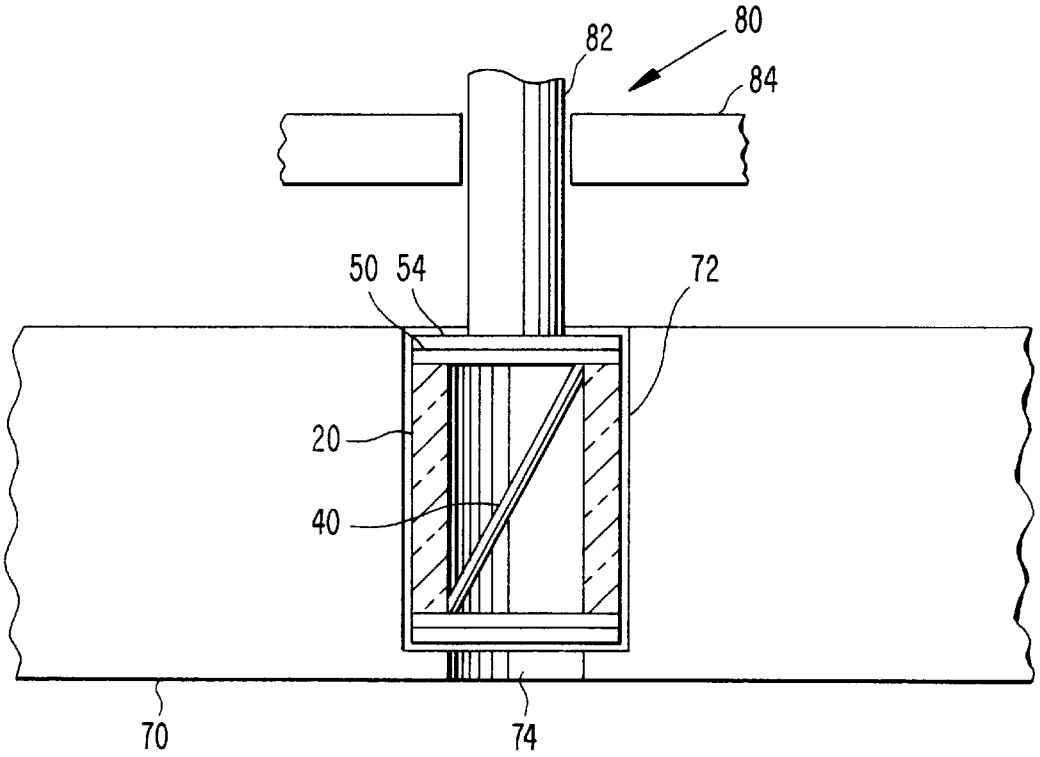
FIG. 5 is a schematic view of a fixture for manufacturing the subminiature fuse according to the method of the invention.

A method of manufacturing a subminiature fuse may be understood in connection with FIG. 5, which shows schematically a part of an apparatus used in the method. The apparatus includes a fixture 70 for holding the assembly elements of the fuse for the heating step. The fixture includes a plate 70 having a multiplicity of recesses 72, each sized for holding a fuse body 20, solder preforms 50 and end terminations 54 in a selected orientation. The recesses 72 may include a hole 74 at the bottom end to accommodate a lead, if a leaded end termination such as shown in FIG. 4 is used. An apparatus of this type is available from Scientific Sealing Technology of Downey, Calif., as the DAP-2200 Furnace.

The method includes the step of applying the metallized coatings 30 to axially opposite surface end portions of the fuse body. As mentioned, any suitable means may be used to apply the coating 30 to the fuse body, including, but not limited to, deposition and dipping in thick film paste. The metallized coating can be fixed to the fuse body by firing.

The fuse element is placed in the recess in the fixture, which holds it in vertical orientation. A fuse element is then placed in the cavity of the fuse body, the fuse element having a length sufficient to extend from the first end to the second end of the cavity. The vertical orientation of the fuse body and fuse element in the fixture allows the fuse element to assume naturally the diagonal position shown and greatly simplifies manufacturing by eliminating special handling conventionally required to position the fuse element in this manner.

A solder or brazing preform is placed at each of the first and second ends of the cavity and an end termination is placed at each of the first and second ends in contact with the preform. The assembly thus formed is heated to a temperature sufficient to cause the preforms to soften and flow for bonding the fuse element to the end terminations. The metallized portions also soften to bond the end terminations to the end portions of the fuse body. The end terminations then form hermetic seals closing the ends of the cavity.

The heating step is preferably performed directly by use of the fixture plate 70, which is formed from graphite and includes electrical connections. Electric current is passed through the plate 70, which is heated by resistance. Heat in the plate 70 is then transferred to the recesses, and thus directly to the assembled components of the fuse.

According to a preferred aspect of the invention, the fixture plate has a multiplicity of holes, and the fuse bodies are placed in the holes by placing a multiplicity of fuse bodies on the upper surface of the fixture plate and vibrating or shaking the plate to cause the fuse bodies to each fall into a recess. The recesses are formed with a diameter slightly larger than the width of the fuse bodies to facilitate entry of the fuse bodies in a recess. After the fuse bodies are installed in the recesses, a multiplicity of fuse elements is placed on the upper surface of the fixture plate 70, and the plate is again vibrated or shaken to cause the fuse elements each to fall into a recess and into the cavity in the fuse body.

The vibration step is also advantageous for assembling rectangular profile fuse bodies 20 with end caps 56 which must be oriented correctly so that the cap is placed over the end portion of the fuse body. The caps 56 are placed in recesses 72, and the vibration of the fixture plate 70 also succeeds in causing the fuse bodies to align with and insert in the caps.

According to another aspect of the invention, the method includes the steps, prior to the heating step, of placing the assembled fuse body, fuse element, solder or brazing preforms and end terminations in an environmentally controlled chamber. The chamber may then be evacuated and then charged with a selected gas so that the cavity is filled with the selected gas before being sealed. The selected gas may be chosen for arc quenching property, for example, sulfur hexafluoride. Alternatively, a gas having insulating properties may be chosen, particularly for a time-lag fuse construction. The selected gas may be an inert gas, such as nitrogen. The selected gas may be provided at a pressure greater than atmospheric or less than atmospheric pressure. Alternatively, the selected gas may be air.

A weighting device 80 may be used to apply pressure to the assembly of the fuse body 20, solder preforms 50 and end terminations 54 while the heating step is performed to ensure that the components effectively and securely bond. The weighting device 80 includes a supporting frame 84 and a multiplicity of weight rods 82 slidably supported in the frame. The weighting device 80 provides one weight rod 82 for each of the recesses 72. The frame 84 is mounted on legs (not shown) in position above the upper surface of the fixture plate so that the weight rods 82 align with the recesses in the fixture plate 70. The frame 84 and fixture plate 70 may be provided with alignment holes and mounting in mutual alignment through the use of posts engaging the alignment holes.

The invention has been described and illustrated in terms of preferred embodiments and principles, however, it should be recognized that variation and changes may be made without departing from the invention as defined in the following claims.

We claim:

1. A method for making a subminiature fuse, comprising the steps of:

applying metallized coatings to surfaces including an interior surface at axially opposite ends of a hollow fuse body having an internal cavity and openings at the axially opposite ends;

placing a fuse element in the internal cavity in the fuse body, the fuse element extending between the first end to the second end and contained within the cavity;

placing one of a solder preform and a brazing preform at each of the first and second ends of the cavity;

placing one end termination at each of the first and second ends in contact with the preform;

heating the assembled fuse body, fuse element, preforms and end terminations to a soft point temperature of the preform material to cause the preforms to bond the fuse element to the end terminations and for the end terminations to bond with the metallized end portions of the fuse body, wherein the end terminations form hermetic seals closing the ends of the cavity.

2. The method as claimed in claim 1, further comprising the steps, prior to the heating step, of:

placing the assembled fuse body, fuse element, preforms and end terminations in an environmentally controlled chamber, evacuating the chamber of air, and charging the chamber with a selected gas.

3. The method as claimed in claim 2, wherein the selected gas is an inert gas.

4. The method as claimed in claim 2, wherein the selected gas is sulfur hexafluoride.

5. The method as claimed in claim 1, wherein end face portions of the fuse body at the openings are coated with the metallized coating.

6. The method as claimed in claim 1, wherein lateral outer surfaces adjacent the ends are coated with the metallized coating.

7. The method as claimed in claim 1, further comprising the step of placing the fuse body in a recess in a fixture in a vertical orientation, before the step of placing a fuse element in the cavity in the fuse body.

8. The method as claimed in claim 1, wherein the fuse element is disposed in the cavity to extend diagonally across the cavity and has a rigidity sufficient to avoid contact with an interior surface of the fuse body between the first end and second end.

9. The method as claimed in claim 8, wherein the fuse element comprises a wire element wound on an electrically insulating core.

10. The method as claimed in claim 8 wherein the fuse element comprises a wire wound on an electrically conductive core.

11. The method as claimed in claim 8, wherein the fuse element comprises an electrically conductive film element carried on an electrically insulating substrate.

12. The method as claimed in claim 1, wherein the end terminations comprise disk-shaped elements of electrical conductive material, wherein the disk-shaped elements are placed in contact with end faces of the fuse body.

13. The method as claimed in claim 1, wherein the end terminations comprise caps, and the method further comprises the step of placing the caps over the metallized end portions of the fuse body, said end portions including the metallized coatings.

14. A subminiature fuse, comprising:

a fuse body formed of electrically insulating material and having an internal cavity extending from a first end to a second end, the first and second ends each having an opening communicating with the cavity;

a metallized coating applied to portions of the fuse body at both the first end and second end, the metallized coating covering an outer end face, inner end portion surfaces, and outer end portion surfaces;

a fuse element contained in the cavity and extending from the first end to the second end, ends of the fuse element being in proximity to the metallized coating on the inner end portion surfaces of the fuse body;

end terminations at both the first end and the second end, the end terminations bonded to the fuse body on the metallized coated surfaces, wherein the terminations form a seal closing the cavity; and electrical conductive material disposed between the end terminations and terminal portions of the fuse element at both the first end and the second end of the cavity, the material forming an electrically conductive joint connecting the end terminations to the fuse element.

15. A subminiature fuse as claimed in claim 14, further comprising an inert gas contained in the internal cavity.

16. A subminiature fuse as claimed in claim 14, further comprising sulfur hexafluoride gas contained in the internal cavity.

17. A subminiature fuse as claimed in claim 14, wherein the internal cavity contains a gas at a pressure less than atmospheric pressure.

18. The subminiature fuse as claimed in claim 14, wherein the internal cavity is evacuated.

19. A subminiature fuse as claimed in claim 14, wherein the fuse body is a tubular shaped body having a rectangular profiled exterior, and the end terminations comprise a disk-shaped end plate bonded to end surfaces of the fuse body.

20. A subminiature fuse as claimed in claim 14, wherein the end terminations comprise end caps, each disposed over a portion of the fuse body at the first end and the second end.

21. A subminiature fuse as claimed in claim 14, wherein each end termination includes a lead extending therefrom for connecting the fuse in an electrical circuit.

22. A subminiature fuse as claimed in claim 14, wherein the fuse element includes a fusible link carried on a substantially rigid substrate and extends diagonally across the cavity to avoid contacting an interior of the fuse body between the first and second ends.

23. A subminiature fuse as claimed in claim 14, wherein the fuse element comprises a fusible wire element wound on an electrically insulating core.

24. A subminiature fuse as claimed in claim 14, wherein the fuse element comprises a conductive film deposited on a substrate of insulating material.

25. A method for making a subminiature fuse, comprising the steps of:

applying metallized coatings to surfaces at axially opposite ends of a hollow fuse body having an internal cavity and openings at the axially opposite ends;

placing the fuse body in a recess in a fixture in a vertical orientation;

placing a fuse element in the internal cavity in the fuse body, the fuse element extending from the first end to the second end of the cavity;

placing one of a solder and brazing preform at each of the first and second ends of the cavity;

placing one end termination at each of the first and second ends in contact with the preform;

heating the assembled fuse body, fuse element, preforms and end terminations to a soft point temperature of the preform material to cause the preforms to bond the fuse element to the end terminations and for the end terminations to bond with the metallized end portions of the fuse body, wherein the end terminations form hermetic seals closing the ends of the cavity.

26. A subminiature fuse, comprising:

a fuse body formed of electrically insulating material and having an internal cavity extending from a first end to a second end, the first and second ends each having an opening communicating with the cavity, wherein the fuse body is a tubular shaped body having a rectangular profiled exterior;

a metallized coating applied to portions of the fuse body at both the first end and second end, the metallized coating covering an outer end face and an outer end portion surface;

a fuse element disposed in the cavity and extending from the first end to the second end;

end terminations at both the first end and the second end, the end terminations bonded to the fuse body on the metallized coated surfaces, the end terminations including an end plate bonded to end surfaces of the fuse body, wherein the terminations form a seal closing the cavity; and electrical conductive material disposed between the end terminations and terminal portions of the fuse element at both the first end and the second end of the cavity, the material forming an electrically conductive joint connecting the end terminations to the fuse element.

* * * * *